United States Patent [19]

Kovaleski et al.

[11] Patent Number: 4,768,364

[45] Date of Patent: Sep. 6, 1988

[54] CONTINUOUS COILING MACHINE FOR ROD AND STRIP STOCK

[75] Inventors: Joseph J. Kovaleski, Easton; Gordon L. Bauer, Shelton, both of Conn.

[73] Assignee: Wyrepak Industries, Inc., Bridgeport, Conn.

[21] Appl. No.: 926,678

[22] Filed: Nov. 4, 1986

[51] Int. Cl.[4] ..... B21C 47/00

[52] U.S. Cl. ..... 72/132; 72/134; 242/83

[58] Field of Search ..... 72/127, 129, 130, 132, 72/133, 134, 135, 138, 142, 144, 146, 147, 148; 242/78, 79, 81, 82, 83

[56] References Cited

U.S. PATENT DOCUMENTS

| | | | |
|---|---|---|---|
| 2,957,640 | 10/1960 | Lewis | 242/83 |
| 3,054,570 | 9/1962 | Nye | 242/83 |
| 3,952,569 | 4/1976 | Lauterjung | 72/134 |
| 4,643,012 | 2/1987 | Wiedemann | 72/134 |

FOREIGN PATENT DOCUMENTS

| | | | |
|---|---|---|---|
| 1294907 | 5/1969 | Fed. Rep. of Germany | 242/82 |
| 1402717 | 2/1970 | Fed. Rep. of Germany | 242/82 |
| 2702134 | 7/1977 | Fed. Rep. of Germany | 72/132 |

*Primary Examiner*—E. Michael Combs
*Attorney, Agent, or Firm*—H. Gibner Lehmann; K. Gibner Lehmann

[57] ABSTRACT

A continuous-acting take-up, coiling, cut-off and spooling machine is adapted for use with continuously producing metal casting equipment that casts metal rod or strip stock at a constant rate, and which produces the cast rod or strip stock at a relatively constant velocity. The machine coils, cuts-off, temporarily accumulates and spools or packages determinate lengths of the rod or strip stock formed by the casting apparatus. Driven rollers receive the leading end of the rod or strip stock. The rod or strip stock is cut to predetermined, desired lengths while still in motion so as to not disturb the feed velocity. Free-wheeling rollers forcibly impart a slight curvature and simultaneous axial displacement to the rod or strip stock along its length, forming coils or convolutions of helical configuration, which are deposited by gravity, over a turnably driven reel carried on a tiltable turntable. Provision is made for interrupting, after the filling of a reel, the helical deposition of rod or strip stock thereon, when the reel is either partially or else completely filled. A simultaneous accumulation of a limited number of convolutions of oncoming rod or strip stock is commenced, in a storage area lying immediately above the reel. After a substitute, empty reel is loaded, those convolutions which have accumulated in the storage area are released, and fall so as to be deposited directly onto the fresh reel. Turning of the latter is again initiated. Oncoming subsequently formed convolutions fall directly through the storage area and are deposited onto the new reel.

26 Claims, 10 Drawing Sheets

CONTINUOUS COILING MACHINE FOR ROD AND STRIP STOCK

STATEMENTS AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates generally to equipment for coiling or spooling elongate metal stock, and more particularly to spooling devices especially adapted for use with heavy gauge metal rod or strip stock.

2. Description of the Related Art Including Information Disclosed Under 37 CFR §§1.97–1.99

In particular, the present invention is intended to receive stiff or heavy gauge (8 mm. to 30 mm.) metal rod or strip stock from a casting machine of the type illustrated and described in U.S. Pat. No. 4,414,285 dated Nov. 8, 1983, issued to the General Electric Company, and entitled "Continuous Metal Casting Method, Apparatus and Product".

The above identified patent illustrates a method and apparatus for continuously forming stiff or heavy-gauge solid rod or strip stock from molten metal contained in a reservoir by a process known as "levitation" wherein molten metal is drawn vertically upward through a levitator tube constituted of refractory material, by means of a magnetic field produced by a series of electromagnetic coils wound around the tube, the tube being disposed vertically and having its lower end completely submerged in the molten metal. The application of 3-phase power to the coils results in a continuous, upwardly-directed vertical force being applied to the column, which begins to solidify as it travels upward in the tube, such that long, uninterrupted lengths of metal stock can be formed in a continuous, non-stop process.

It has been found that once the generation of metal stock as above indicated has commenced, interruption in the process is best avoided due to lost time resulting from start-up or shut-down operations. Accordingly, there has existed a need for satisfactorily handling the solidified stiff or heavy gauge stock, such as cutting it to the desired length, spooling and storing it, etc., all of which must be accomplished without disruption in the speed of the rod or strip stock that is emerging from the casting machine, or other interruptions in the casting process.

SUMMARY OF THE INVENTION

The problems of storage and handling of cast metal stiff rod or strip stock as outlined above are solved by the present invention, which has for an object the provision of a novel and improved machine and method for satisfactorily spooling quantities of continuously produced stiff metal rod or strip stock, which is simple and reliable, and which is especially adapted for use with casting machinery that operates continuously for extended periods of time, essentially without interruption.

A related object of the invention is to provide an improved machine and method as above set forth, which are capable of readily cutting rod or strip stock to predetermined lengths as the rod or strip stock is being continuously fed from the casting machine, all without causing interference to, or disruption of the casting process.

Still another object of the invention is to provide an improved machine of the above type, wherein a portion of the rod or strip stock received from the casting machine can be formed or bent sufficiently to permit its being applied to a wire-storage device such as a reel or "pipe stem", while the casting of other up-stream portions of the rod or strip stock is continuing.

Yet another object of the invention is to provide an improved machine of the kind indicated, wherein rod or strip stock that is being received from the casting machine can be temporarily stored in an accumulator area while a reel or pipe stem that has become filled is removed and replaced with an empty reel, without interruption in or interference with the operation of the casting machine.

A still further object of the invention is to provide an improved machine as outlined above, wherein stock that has been temporarily stored in the accumulator area can be readily transferred to a subsequent, empty reel after the latter has been placed in position, and wherein subsequent portions of stock are then automatically deposited on the said subsequent reel.

A further object of the invention is to provide an improved machine in accordance with the foregoing, wherein access to the location of the reel being filled is facilitated, and wherein removal of filled reels or replacement by empty reels is conveniently done to the extent that this can be effected manually, as required, by relatively unskilled personnel.

The above objects are all accomplished by the present improved semi-automatic machine which advantageously coils and successively stores finite quantities of heavy cast rod or strip stock from a continuously produced supply. The machine as provided by the invention essentially comprises a support structure, a take-up reel carried thereby which is adapted to receive a predetermined length of heavy rod or strip stock (8 to 30 mm., for example), powered means for turning the reel as it receives the rod or strip stock, and powered impelling means for axially advancing the rod or strip stock and drawing it into the machine as it is being received. The machine has a unique guide means to impart a curl to the rod or strip stock prior to its being deposited on the reel. A travelling cutter is movable on the support structure between starting and ending positions at a speed which is the same as that of the travelling stock by virtue of its engagement therewith, in order to effect a severing of the rod or strip stock at a desired location during such travel, all without interruption of the stock movement. Following the severing step, the cutter automatically returns to its starting position in readiness for the next cut.

Novel temporary storage means are provided in the space above the reel, adapted to accumulate the oncoming stock while reels are being exchanged, and to deposit such accumulated stock onto a new, empty reel when the latter has been placed in its proper position.

The machine of the invention incorporates unique reel drive means comprising telescoped, axially movable, splined upright shafts located above the reel, and a separable semi-integral clutch disposed between one of the shafts and the reel, which clutch is adapted to become disengaged in response to raising movement of one shaft, together with means for applying a powered turning movement to the other of the shafts. Under declutched conditions, a filled reel can be readily removed and an empty one substituted in its place.

Simplified means are provided for mounting the travelling cutter on the support structure for movement simultaneously with the heavy gauge rod or strip stock, from its starting position toward its end position. As the cutter moves along with the stock, it is actuated to perform the cut without interruption in the movement of either of the cut ends of the stock. Following this the cutter is power driven by a simple cable return back to its starting position in a direction opposite to that of the movement of the stock.

The present improved machine has positive-driven serially-arranged multiple powered impelling units for axially frictionally advancing the rod or strip stock which is to be loaded on the reel. The impelling units include multiple pairs of opposed cooperable wheels between which the rod or strip stock passes. Gears positively couple corresponding wheels of the pairs for turning in the desired directions. Also, guide bushings are located between the pairs of opposed wheels, to maintain an alignment of the heavy gauge rod or strip stock which is being handled.

The machine of the invention further has novel helix-forming means on the support structure, which imparts a curl to the stock to form it into a screw-like shape suitable for deposition on the reel. Large-capacity temporary storage means are provided for the curled rod or strip stock, comprising a power-driven core form having its axis upright; the core form is adapted to have the curled rod or strip stock wrap around it, and the temporary storage means includes automatic extendable and retractable abutments at the lower portion of the core form, to support the rod or strip stock that is being wrapped thereon.

The powered means for effecting turning movement of the reel includes a turnable driving clutch member having an upright axis which is disposed immediately above the reel and which is shiftable axially into or out of direct engagement with the reel, and a cross head on the support structure, having a thrust bearing connected with the drive member. Power means are provided for raising and lowering the crosshead. With the crosshead raised, the reel is free to turn and becomes accessible for removal, following which another, empty reel can be installed in its place.

To operatively mount the reels, the invention provides a free-turning rotary table means; the powered means which effects turning movement of the reel also powers the free-turning table means. A unique stop mechanism is movably carried by the table means and is adapted to hold captive or else release the currently used reel. Additional means are provided, registerable with the stop mechanism, for actuating the same and releasing the reel for transport at one given predetermined rotative position of the table means.

The core form of the large capacity temporary storage means has abutments in the form of pivoted fingers disposed in a circle about the axis of the core form at its lower portion. A vertically movable cone cam actuates the pivoted fingers, enabling them to move between radial positions wherein they support coils of the rod or strip stock, and vertical positions wherein the stock can by-pass them and be deposited directly onto the reel.

A simplified mounting for the reel comprises a table part and a frame part. The table part can undergo limited tilting on the frame part about a horizontal axis, and carrier means on the table part enables a heavily loaded reel to be easily removed when the table part is tilted.

The unique stop mechanism on the table part comprises an angular member and a plunger pivotally connected to one leg of the member, together with rollers carried by the knee of the member and adapted to engage and travel on the top of the frame part as the plunger is moved axially. The other leg of the member is engageable with an up-ended reel on the table part.

Other features and advantages will hereinafter appear.

BRIEF DESCRIPTION OF THE DRAWINGS

In the drawings, illustrating a preferred embodiment of the invention:

FIG. 10 is a fragmentary vertical section of the machine of

FIGS. 1–9 taken on the line 10—10 of FIG. 1, the line 10—10 of FIG. 3, and the line 10—10 of FIG. 4.

DESCRIPTION OF THE PREFERRED EMBODIMENT

Figure 2:
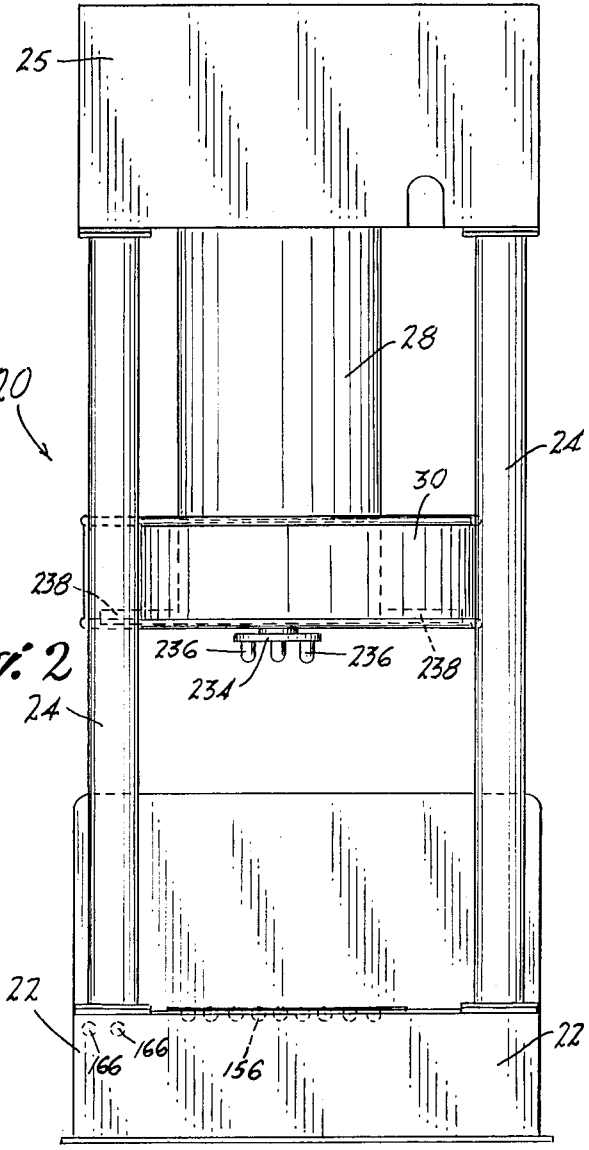
FIG. 2 is a right side elevation of the machine of FIG. 1 but with the reel removed.

The continuous-acting take-up, coiling, cut-off, accumulator and spooling machine of the present invention is adapted for use with continuous-producing metal casting equipment that casts elongate metal stock such as heavy gauge rod or strip stock at given speeds and which typically produces the cast rod or strip stock at a relatively constant velocity. As noted above, equipment of this type is illustrated and described in U.S. Pat. No. 4,414,285. The cast rod or strip stock emerges from the casting equipment as a single, continuous straight piece of indeterminate length, after having passed through one or more rolling stations, such as those designated 14 and 15 in the patent.

The apparatus of the invention basically performs a coiling, cut-off, temporary accumulating and industrial spooling or packaging of determinate lengths of heavy gauge rod or strip stock formed by the casting apparatus. Driven rollers in the apparatus are arranged to initially receive the leading end of the rod or strip stock, and to maintain tension in the succeeding lengths emerging from the casting machine. In addition, the apparatus of the invention selectively cuts the rod or strip stock to predetermined, desired lengths while the rod or strip stock is still in motion so as to not disturb the feed velocity (which would cause bending or buckling, etc.) of that portion between the casting machine and the driven rollers. Thereafter several freewheeling rollers in the apparatus forcibly impart a slight curvature and a simultaneous axial displacement to the rod or strip stock along its entire length, forming coils or convolutions of generally helical configuration so as to permit them to be deposited by gravity, helically over a turnably driven reel or "pipe stem" disposed within the apparatus and carried on a tiltable table supported by a turnable frame. Provision is made for interrupting, after the filling of a reel, the helical deposition of rod or strip stock thereon, when the reel is either partially or else completely filled with the desired length of rod or strip stock. The turning of the reel is halted and a simultaneous accumulation of a limited number of convolutions of oncoming rod or strip stock is commenced in a helix-accommodating or guiding storage area disposed immediately above the reel. After the filled reel is removed, a substitute empty reel is loaded into place. The tiltable table on the frame facilitates manual unloading and loading of the reels. In addition, following the installation of the new reel, those convolutions which have accumulated in the storage area are released, and fall so as to be deposited directly over the end of the fresh reel. Turning of the latter is then again initiated. Oncoming subsequently formed convolutions fall directly through the storage area and are directly deposited onto the new reel. The above process is then repeated as long as desired, that is, during such time as formed rod or strip stock is being supplied from the casting machine.

Figure 1:
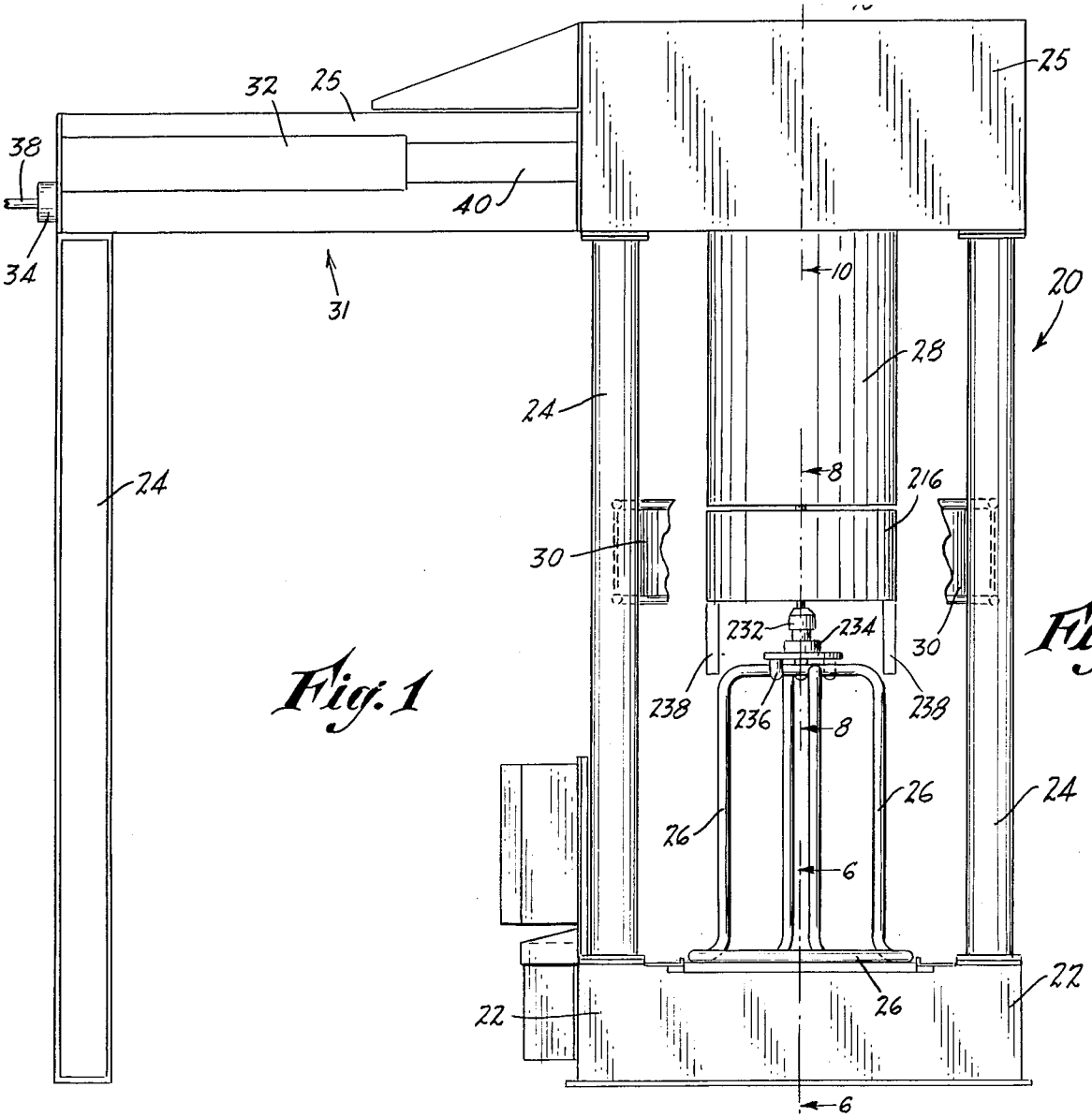
FIG. 1 is a front elevational view of the improved rod or strip stock coiling and storage machine of the present invention, illustrating an empty reel or "pipe stem" in position on the machine, in, readiness for accepting coiled rod or strip stock.

Referring first to FIGS. 1 and 2, the novel and improved rod or strip stock spooling apparatus of the invention is generally designated by the numeral 20. It comprises a base or support structure 22 which is adapted to rest on the floor or other support surface at a location adjacent to the output port of the casting machine (not shown). Extending upwardly from the lower portions of the support structure are multiple support posts 24 that mount, in a housing 25, a series of rollers and a cutting apparatus to be described below. The support structure 22 turnably carries an open ended reel 26, known in the trade as a "pipe stem", which is shown in side elevation in FIG. 1 and in top plan view in FIG. 5. The reel 26 is constituted as a number of pipe sections that are bent into the configurations illustrated and welded together at their various points of contact. The pipe stem or reel 26 typically has four parallel upright posts located about a central axis, and around which the coils of rod or strip stock may be wound; it also has a box-like base portion lying generally in a single plane and functionally corresponding to an end flange of a conventional wire-carrying reel or spool. The reel 26 can receive coils of heavy gauge rod or strip stock deposited over its upper end as viewed in FIG. 1, and thus it enables such material to be conveniently accumulated, stored and transported as desired.

Rigidly carried above the upper part of the support structure 22 is a generally cylindrical, stationary, helix-accommodating upper core form 28 around which convolutions of heavy gauge rod or strip stock can pass and be guided as they fall, by gravity, from rollers at the top of the posts 24. Also, a large-diameter stationary cylindrical sleeve 30 in the form of a shield or band is carried by the posts 24 and constitutes part of a chamber that provides momentary storage for the rod or strip stock at such times that a reel 26 is being removed from or loaded onto the support structure 22, as will be explained below.

Figure 11:
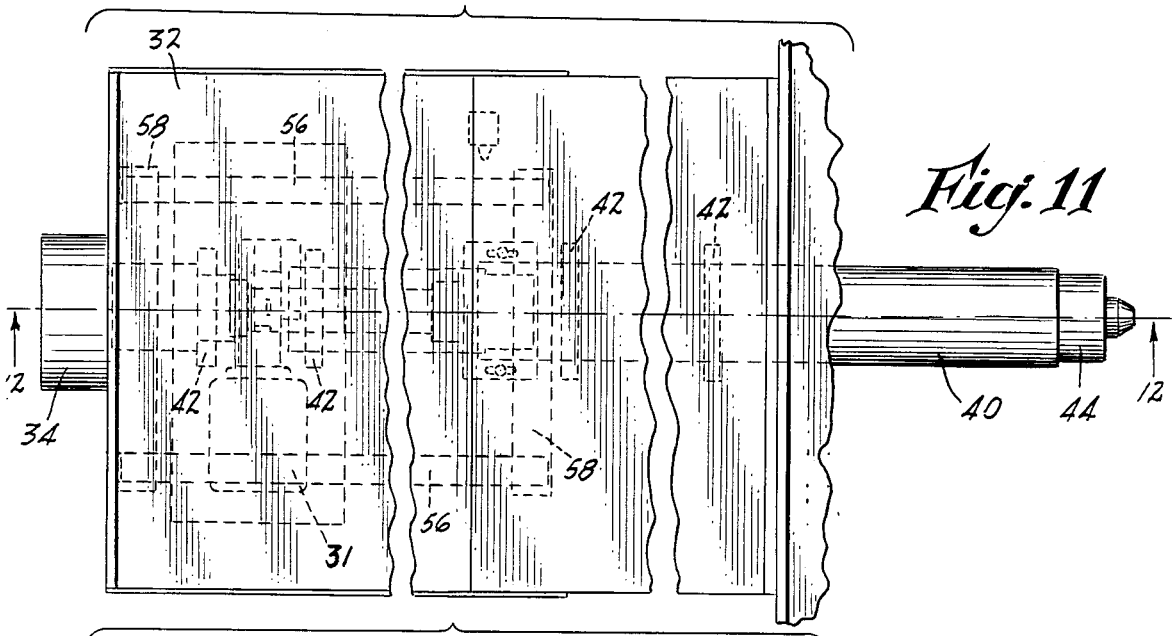
FIG. 11 is a fragmentary top plan view of that portion of the machine in the upper left corner of FIG. 1, containing the travelling cutter device and input guide bushing.
Figure 12:
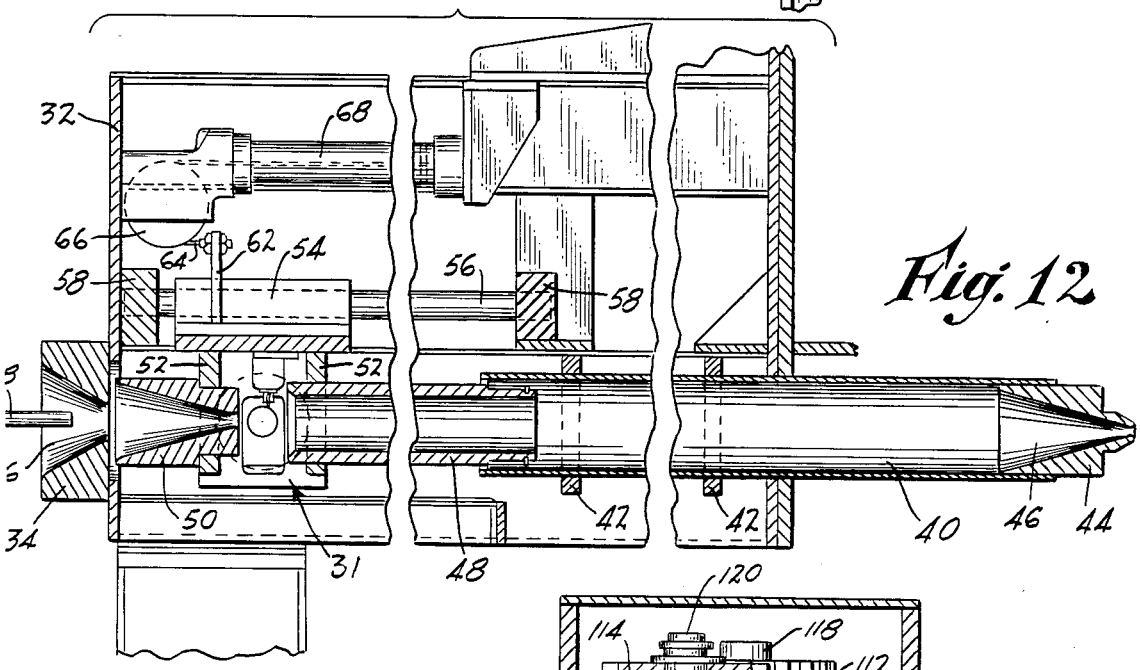
FIG. 12 is a section taken on the line 12—12 of FIG. 11.

The rod or strip stock cutting device carried by the support structure 22 is located at the upper left part of the machine as viewed in FIG. 1, being generally designated 31 and being shown in detail in FIGS. 11 and 12. It comprises an enclosure 32 mounted above the support structure 22 and on one of the support posts 24, and a stationary outermost guide bushing 34, the latter having a conical guide surface 36 that guides moving rod or strip stock 38 emerging from the casting machine (not shown). The rod or strip stock cutting device 31 further comprises a stationary outer telescoping member 40 supported on hangers 42 mounted on the enclosure 32, the right end of the member 40 carrying a nozzle 44 with a conical inner guide surface 46. Telescopically received in the outer member 40 is a movable inner member 48 having a guide bushing 50 at its left end, the member 48 and bushing 50 being suspended from two hangers 52 that are mounted on a carriage 54. The carriage 54 is slidable along two guide bars or rails 56 that are mounted by support blocks 58 which are secured to the enclosure 32. The carriage 54 is movable between a starting position shown in FIGS. 11 and 12, and an ending or termination position wherein the inner telescoping member 48 has become extended into the outer member 40. The carriage 54 carries the cutting mechanism 31 which can be a well-known type, for example, similar to that manufactured by the H. K. Porter Company under their part number W118SQ. The cutting mechanism 31 is so constituted as to effect a forcible pinching of the heavy gauge rod or strip stock 38 at a desired location.

At the upper portion of the carriage 54 is a return-power means acting on the carriage 54, said return-power means comprising an upstanding arm 62 having secured to it a pull cable 64 which passes around a direction-reversing pulley 66 mounted on the enclosure 32, and which extends to the piston of a fluid-actuated cylinder or motive device 68 also mounted on the enclosure 32. In operation, when it is desired to cut the rod or strip stock, the cutting device 31 is actuated by suitable control circuitry (not shown), to accomplish the pinching and severing. The engagement of the cutting mechanism 31 with the rod or strip stock 38 causes the entire assembly including the carriage 54, the inner telescoping member 48 and the guide bushing 50 to move toward the right as seen in FIGS. 11 and 12, against the action of the pull cable 64 and piston of the fluid-actuated cylinder 68. In the instant that it takes to sever the rod or strip stock 38, the assembly travels in unison with the rod or strip stock. Upon completion of the severing, the cutting mechanism 31 ceases to travel with the rod or strip stock and the fluid-actuated cylinder 68 is automatically actuated by means (not shown) to return the mechanism 31 and the carriage 54 to their starting positions shown in FIG. 12.

Figure 3:
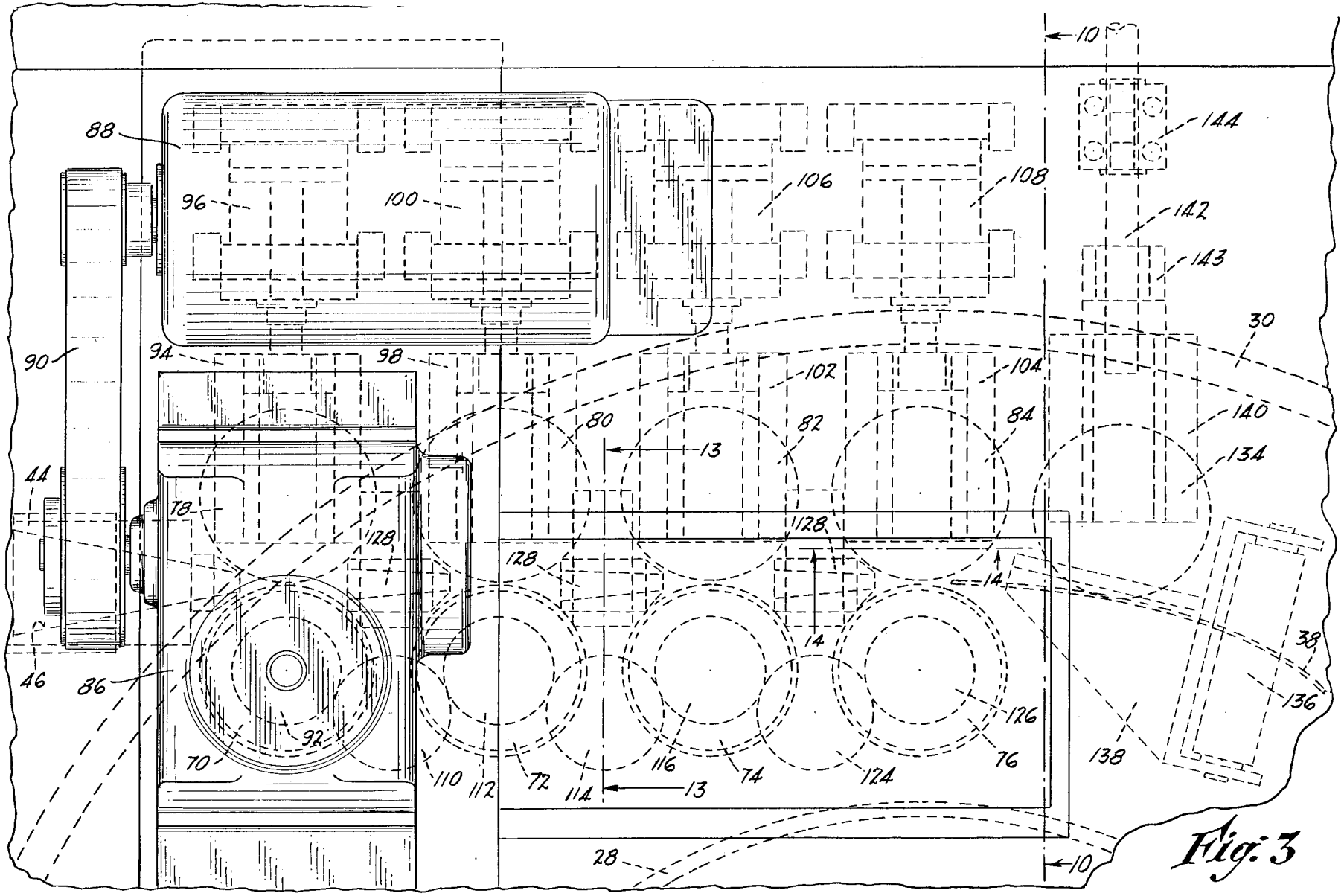
FIG. 3 is a fragmentary top plan view of the machine of FIGS. 1 and 2, particularly illustrating in solid outline an electric motor and gear box, and in dotted outline a series of rollers or wheels arranged to accept rod or strip stock and form it into a helical configuration, suitable for storage on a reel.

Further, in accordance with the invention, there is provided a train of pressure rollers or wheels, shown in dotted outline in FIG. 3, which engage the heavy gauge rod or strip stock as it emerges from the guide bushing 44 and which maintain tension in the rod or strip stock. A total of eight rollers is employed, designated respectively 70, 72, 74, 76, 78, 80, 82 and 84, to advance the rod or strip stock from the guide bushing 44. Four of the rollers, namely those numbered 70, 72, 74 and 76, are turnably driven by power from a reduction gear box 86 and an electric motor 88. These four rollers have annular peripheral grooves that are relatively shallow, to position the rod or strip stock 38 as it is advanced. A belt 90 connects the pulley of the motor 88 to that of the gear box 86. The output of the gear box 86 directly drives a drive pinion 92 and the attached roller 70. The adjacent roller 78 is free-wheeling and is carried on a slide 94 which is advanceable and retractable by means of the piston of a fluid-actuated cylinder 96. That is, the roller 78 is capable of retracting and advancing movement toward and away from the roller 70. The same is true of roller 80, which is carried on a slide 98 and is advanceable and retractable by means of the piston of a second fluid-actuated cylinder 100. During normal operation, the rollers 78, 80 are advanced into engagement with the rollers 70, 72 respectively, and can be temporarily retracted to provide clearance for the leading end of advancing rod or strip stock 38 which has just been cut. Two of the remaining rollers 82, 84 are also carried on slides 102, 104 respectively which are connected to fluid-actuated cylinders 106, 108, but these rollers 82, 84 do not retract to any appreciable extent from the rollers 74, 76; instead, the cylinders 106, 108 operate through the slides 102, 104, to continuously bias the respective rollers 82, 84 into frictional engagement with the adjacent rollers 74, 76 under a relatively constant force or pressure.

The rollers 70, 72, 74 and 76 are all driven simultaneously and in the same directions so as to impel or advance the rod or strip stock 38 being processed. In FIG. 3, the driven pinion 92 engages a first idler gear 110. This in turn engages a second pinion 112 that is coupled to the roller 72, and a second idler gear 114 engaged with the pinion 112 drives another pinion 116 coupled to roller 74. The pinion 112 and idler gear 114 are particularly shown in FIG. 13. The pinion 112 is mounted on a vertical spindle 118, FIG. 13, that also carries the roller 72 (not shown in this figure). The idler 114 is carried on a second vertical spindle 120, both spindles being mounted on a suitable bearing block 122 that is secured to the support structure 22. A third idler gear 124 (FIG. 3) provides drive to the pinion 126 associated with the roller 76, as also seen in FIG. 3.

Figure 13:
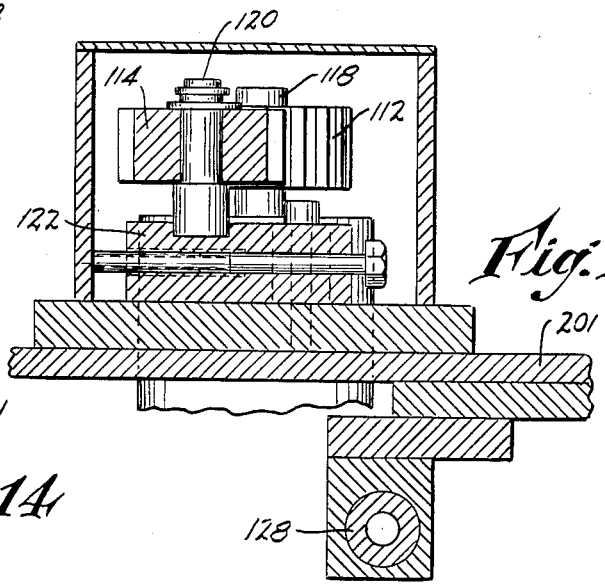
FIG. 13 is a fragmentary section taken on the line 13—13 of FIG. 3.

FIG. 13 additionally shows one of several guide bushings 128 that are disposed between each pair of rollers, in order to insure proper travel of the heavy gauge rod or strip stock 38 along the path defined by the eight rollers 70, 72, 74, 76, 78, 80, 82 and 84 mentioned above.

Figure 14:
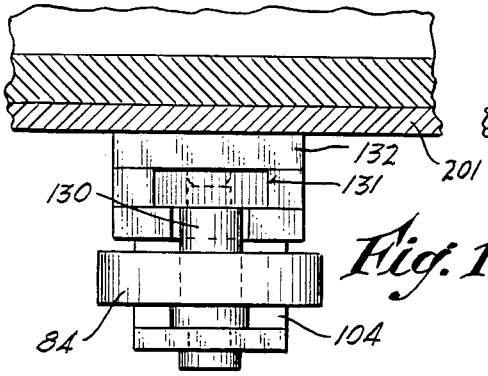
FIG. 14 is a fragmentary section taken on the line 14—14 of FIG. 3.

FIG. 14 illustrates the roller 84. It is carried on a vertical spindle 130 on the slide 104, as noted above. The slide 104 is preferably held captive in and movable along a T-slot 131 formed by a carrier member 132 secured to the support structure 22. The fluid-actuated cylinder 108 (FIG. 3) is not shown in FIG. 14, since it is located directly behind the slide 104 and carrier member 132.

Figure 10:
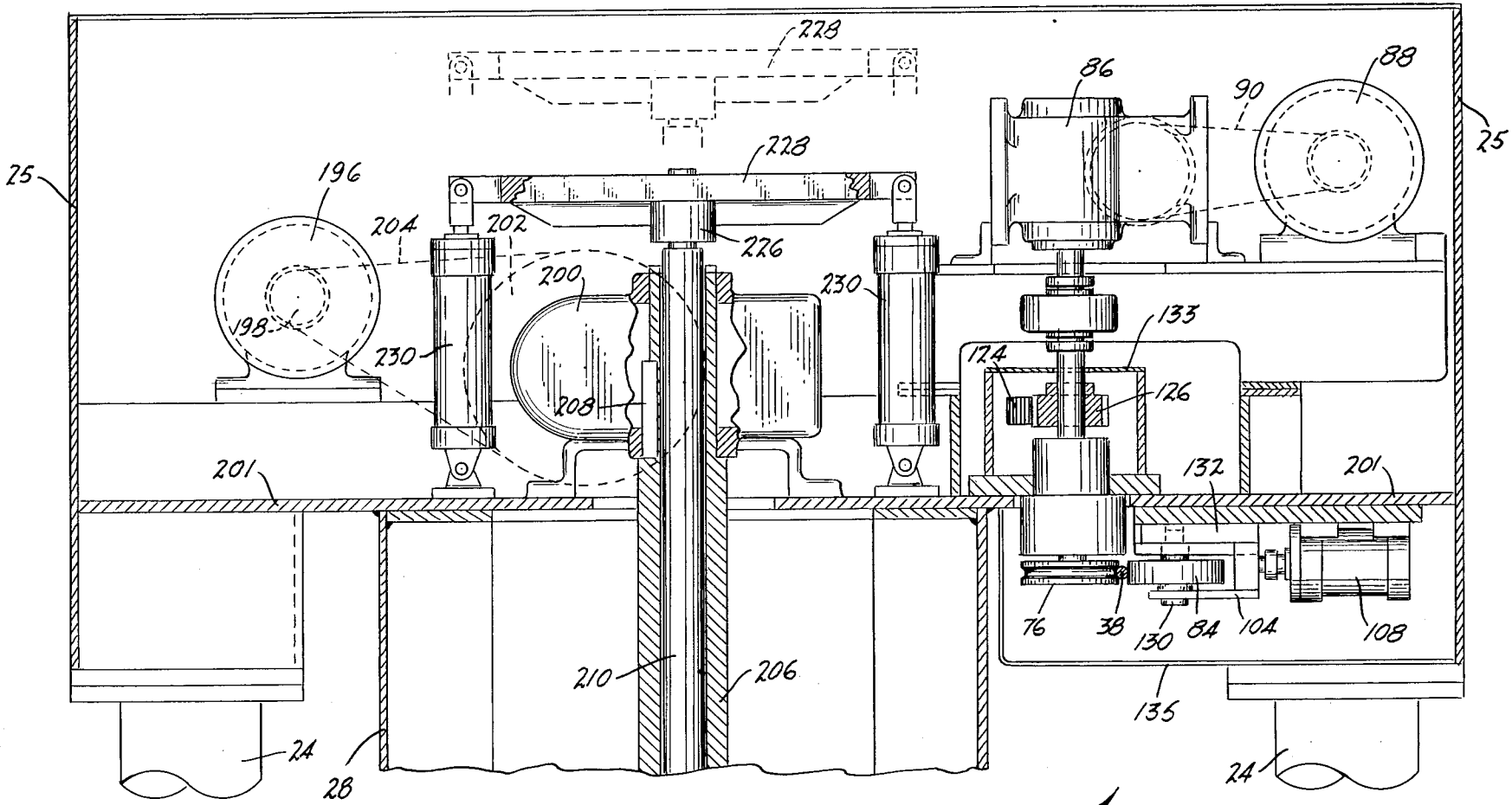

FIG. 10 shows further details of the rollers 76 and 84, the slide 104, the fluid-actuated cylinder 108 and carrier member 132. As noted above, the gear box 86 drives the pinion 126 and roller 76 simultaneously. The rod or strip stock 38 is shown in FIG. 10, disposed between the rollers 76 and 84. The pinion and idler gears are disposed in a lubricant-containing chamber or housing 133, and the drive wheels or rollers in a second, lower chamber or housing 135.

As can be readily understood, the slides 94, 98 and 102 associated with the rollers 78, 80 and 82 are of a construction that is similar to that associated with roller 84 shown in FIG. 14. The rollers 70, 72, 74 and 76 are hereinafter also referred to as drive rollers, and the rollers 78, 80, 82 and 84 as driven rollers.

Figure 17:
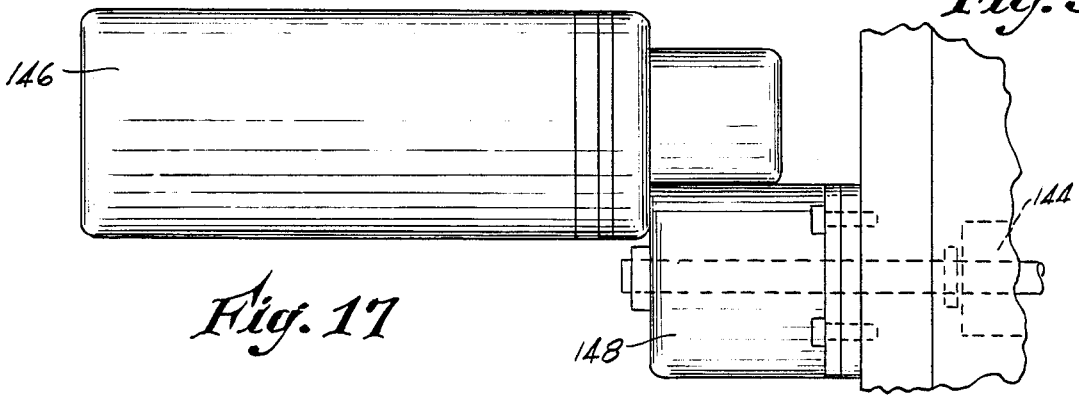
FIG. 17 is a fragmentary top plan view of an electric motor and gear box associated with that one of the rollers of FIG. 3 which is laterally offset and which forcibly imparts an inwardly directed curvature or curl to the rod or strip stock as it passes the said roller. The motor and gear box vary the position of the roller in order to change the degree or radius of curvature of the resultant coils or convolutions.

By the present invention, positive guide means for the stock is provided, comprising a pair of laterally offset guide rollers 134, 136, FIG. 3, located downstream of the pressure rollers above described, the guide rollers being free-wheeling and the one roller 136 being mounted on the support structure 22 by a bracket 138. The position of the roller 136 is adjustable within limits. The second offset roller 134 is mounted on a slide 140 which is disposed in a carrier member similar to that of FIG. 14. At the rear of the slide 140 there is a drive rod in the form of an adjusting screw 142 having a locking nut 143. The screw 142 is connected through a coupling 144, FIGS. 3 and 17, to a reversible electric motor 146 and gear reducer drive 148. Operation of the motor 146 results in forcible advance or retraction of the roller 134. The function of the latter is to impart a slight curl to the rod or strip stock 38, as it advances longitudinally under the action of the pressure rollers. In addition, the roller 136 imparts a slight downward bend to the rod or strip stock 38 such that a helical configuration is generated. The vertical position (perpendicular to the paper in FIG. 3) of the roller 136 can be adjusted in order to set the pitch of the helix, whereas the position of the roller 134 determines the radius of the helix. The resultant helically bent rod or strip stock then forms about the cylinder or core form 28 and falls under the action of gravity past the core form 28 and the upper end of the reel 26 to be accumulated thereon. The core form 28 is now seen as extending downward below the level of the helix-forming guide means 134, 136.

Figure 5:
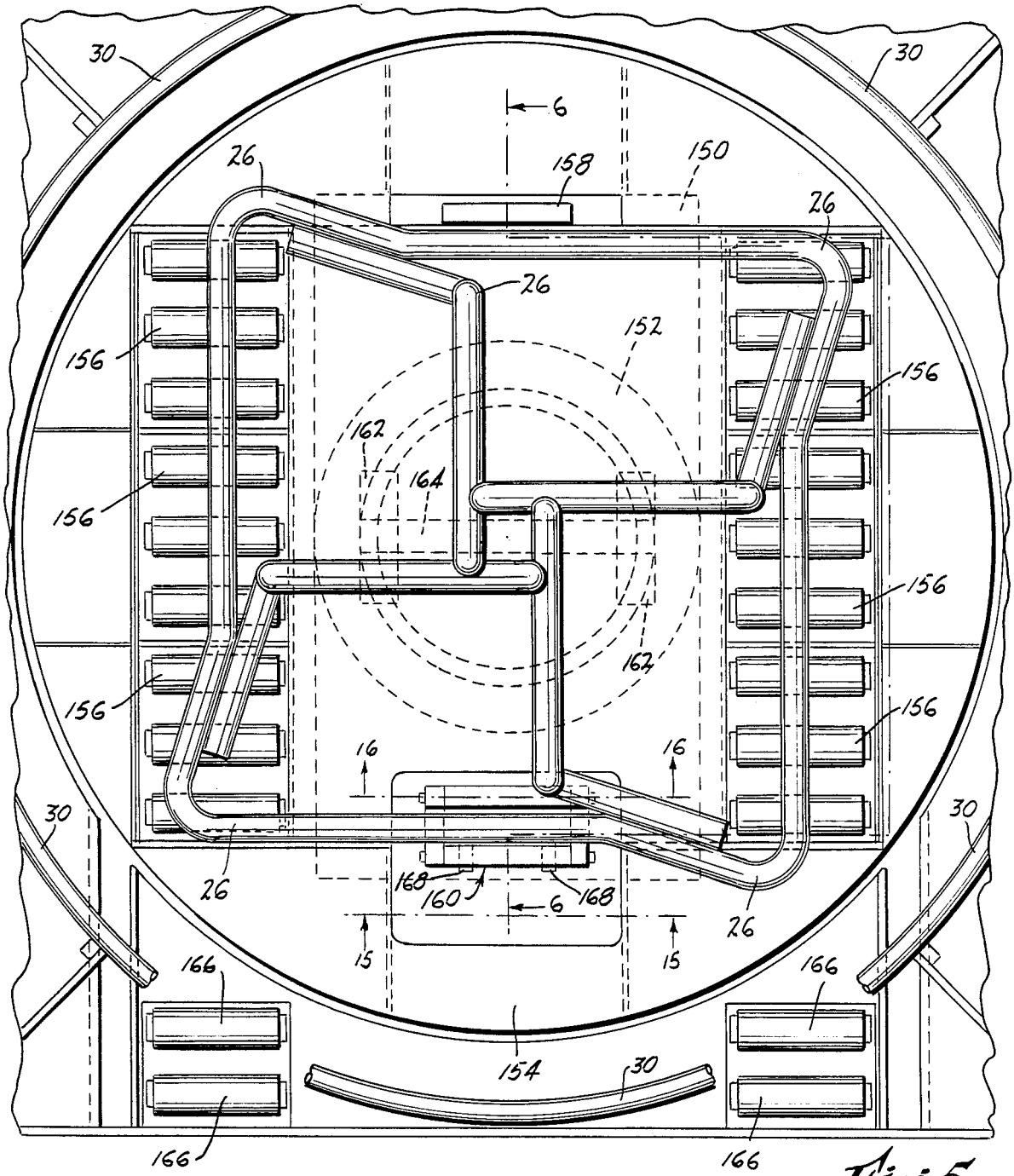
FIG. 5 is a fragmentary top plan view of a reel carried on a tiltable table and support structure of the machine of FIGS. 1–4.
Figure 6:
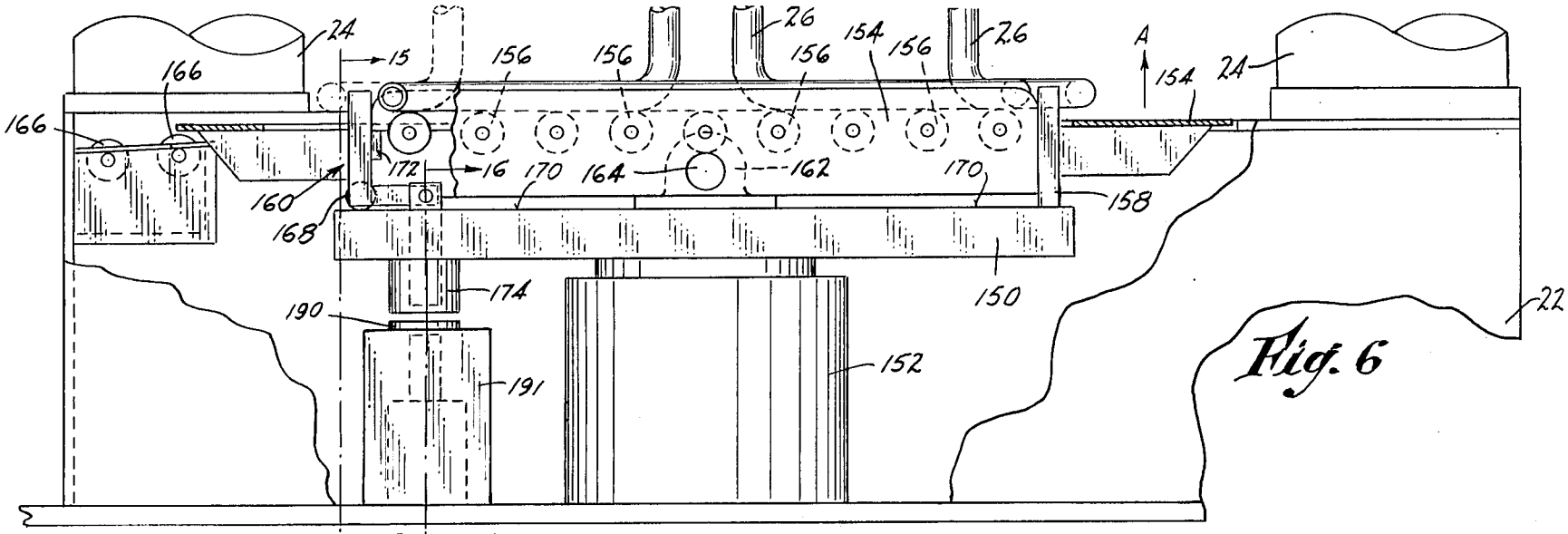
FIG. 6 is a fragmentary section taken on the line 6—6 of FIG. 1, and on the line 6—6 of FIG. 5.
Figure 7:
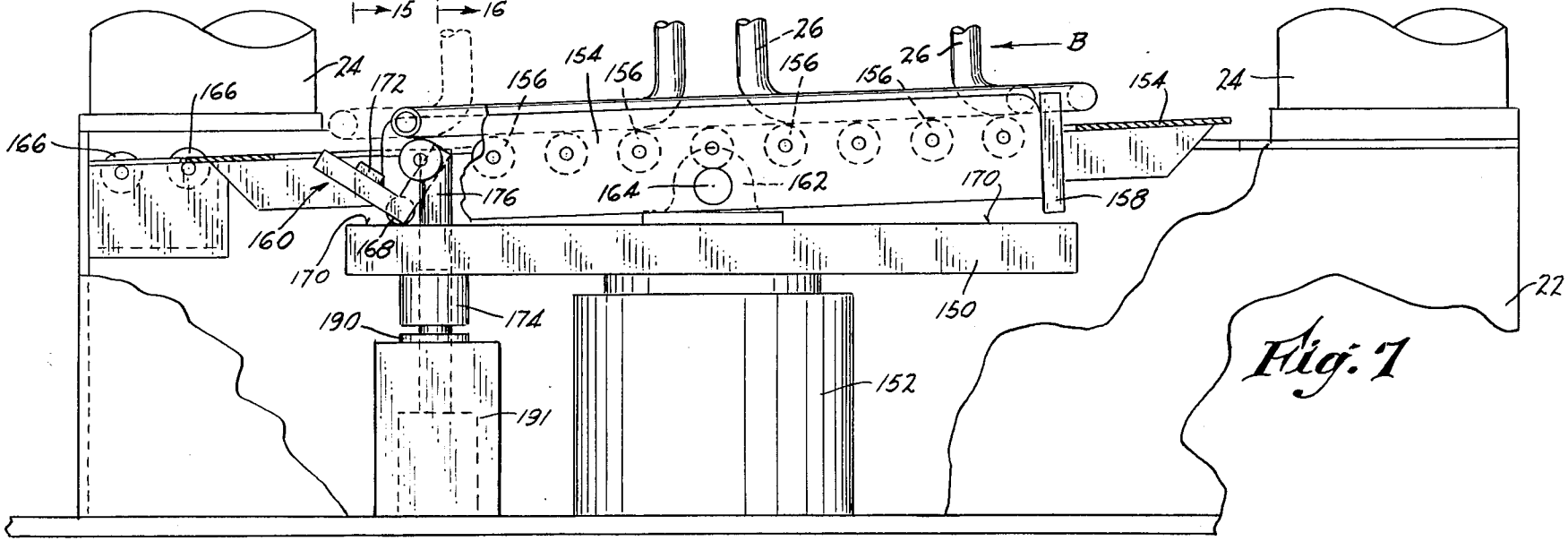
FIG. 7 is a view like that of FIG. 6 except showing the tiltable turntable carried by the platform as having been tilted slightly, to facilitate loading or removal of a reel.

Referring to FIGS. 5–7, the reel 26 is supported on a turntable 154 which is pivotally carried by and tiltable on a platform 150 of the support structure 22. The platform 150 is freely rotatable by means of a lower bearing 152. The turntable 154 has multiple rollers 156 adapted to support parallel opposed rails of the base of the reel 26, as seen in FIG. 5. A fixed positioning stop 158 is provided on the turntable 154 at a location between the series of rollers 156 to prevent the reel 26 from inadvertently rolling off in a rearward direction, and a front movable stop member 160 is provided, which can be shifted between a first blocking position shown in FIG. 6 wherein it retains the reel in place, and a second releasing position shown in FIG. 7, wherein it releases the reel 26 for forward removal by virtue of its being disposed out of the path of movement of the same, or toward the left as seen in FIGS. 6 and 7.

The turntable 154 is mounted on the platform 150 by means of bearing pillow blocks 162, and a spindle 164 carried by the turntable. The tilted position of the turntable 154 is shown in FIG. 7. The support structure 22 has additional sets of rollers 166 constituting carrier means that permit the reel 26 to be slidably transferred from the turntable to a conveyor belt (not shown) or other transport mechanism.

The movable stop member 160 is of angular form and accomplishes several functions. It normally supports the turntable 154 in its non-tilted position shown in FIG. 6, as well as constituting a movable abutment for retaining the reel 26 in place on the table.

Figure 16:
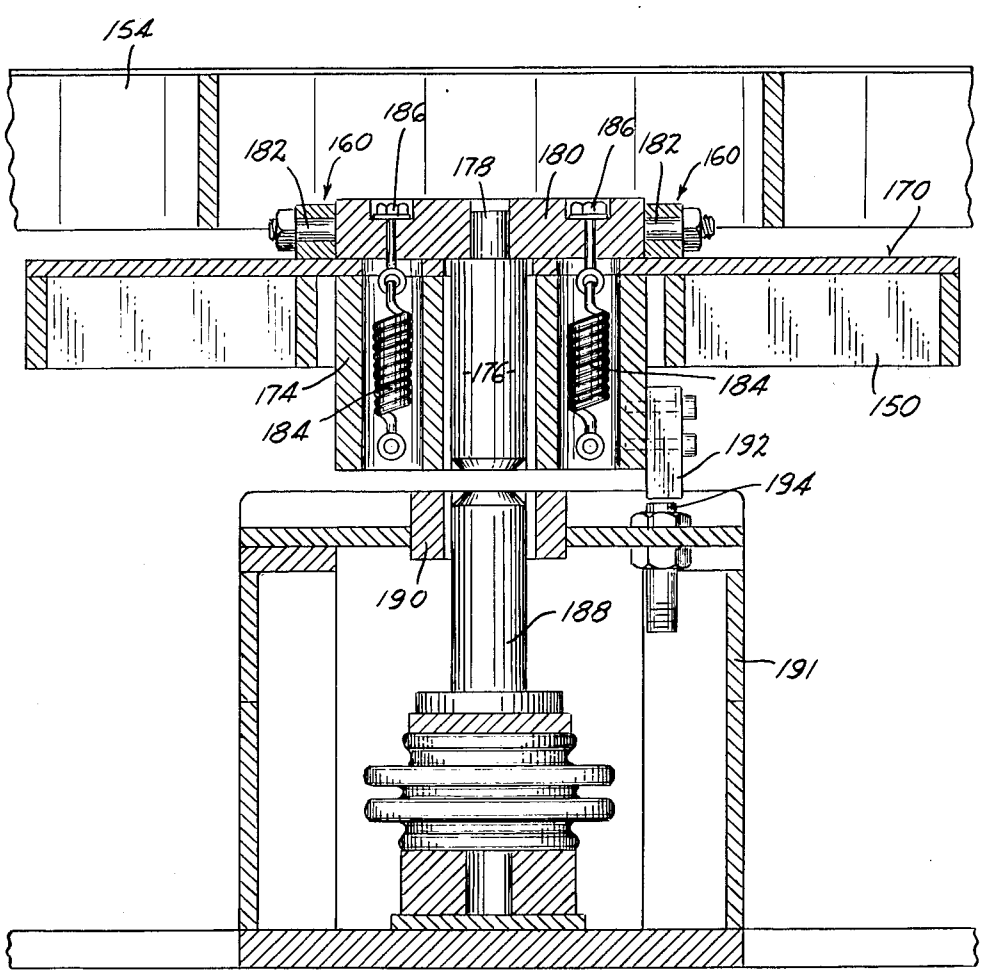
FIG. 16 is a fragmentary section taken on the line 16—16 of FIG. 5, and one the line 16—16 of FIG. 6.
Figure 15:
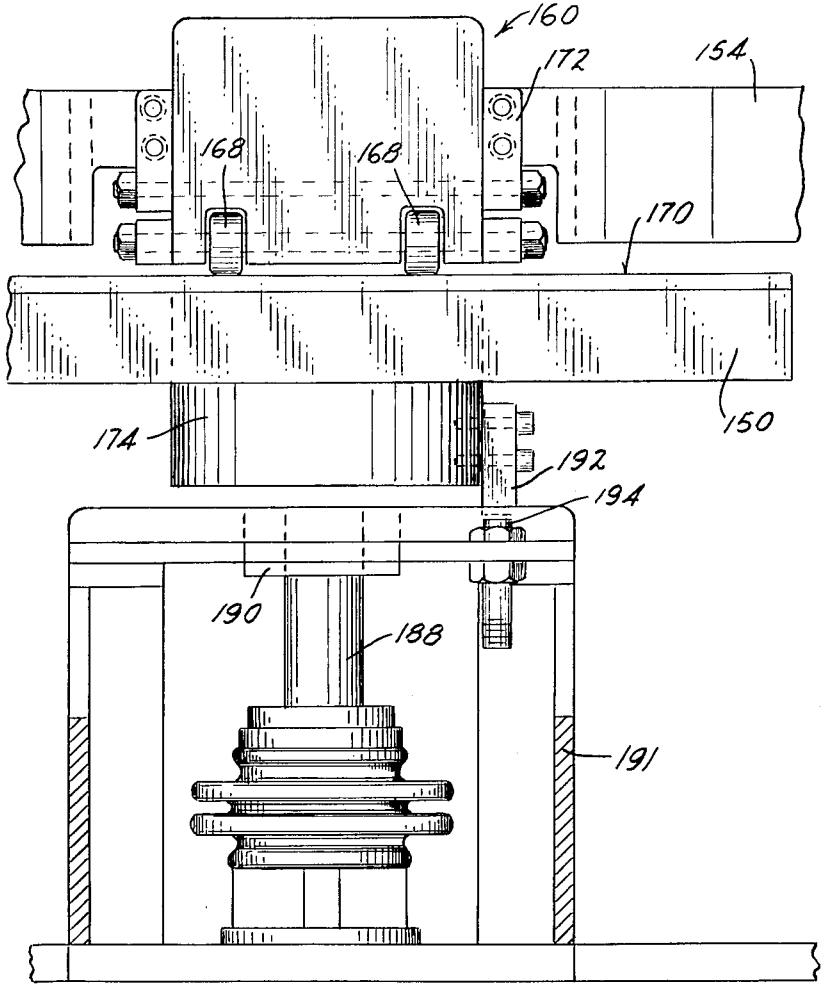
FIG. 15 is a fragmentary section taken on the line 15—15 of FIG. 5, and on the line 15—15 of FIG. 6.

The details of the movable stop member 160 are illustrated in FIGS. 15 and 16. The knee of the member 160 carries two rollers 168 that are slidable over a planar upper surface area 170 of the platform 150. One leg of the member 160 carries an abutment or support shoulder 172 constituting a ledge upon which an end of the tiltable turntable 154 normally rests when the reel 26 is being loaded with the rod or strip stock. The position of the abutment 172 is adjustable to facilitate initial installation of the machine.

Fastened to the underside of the platform 150 is a cylindrical collar 174 in which there is disposed a driven plunger 176, FIG. 16. The plunger 176 has a reduced diameter portion 178 that is received in a hole of a lift bar 180, the latter having spaced, aligned spindles 182 which are received in holes in one leg of the angular stop member 160. Upward movement of the driven plunger 176 results in tilting of the angular member 160 in a counterclockwise direction as shown in FIG. 7, whereas downward movement results in clockwise pivoting to the position of FIG. 6. The lift bar 180 is retained in the position of FIG. 6 by a pair of tension springs 184 housed in oppositely-disposed bores in the collar 174, as in FIG. 16. Two bolts 186 extending through the lift bar 180 secure the upper ends of the springs 184 to the angular member 160, with rivets securing the lower ends thereof to the walls of the collar bores.

Disposed at the periphery of the underside of the platform 150 and mounted on the support structure 22 is a power-operated plunger, hereinafter referred to as a drive plunger 188. The drive plunger 188 extends upwardly through a collar 190 mounted in a housing 191, for end-to-end abutting engagement with the driven plunger 176 when the turntable 154 and platform 150 are in a position aligning the two plungers with each other as in FIGS. 15 and 16. A positioning lug 192 is provided on the collar 174 of the platform 150, and a cooperable marker, comprising a threaded stud 194, is mounted on the housing 152 for the drive plunger 188, to assist the operator in manually aligning the two plungers 176, 188 as required during loading or unloading of the reels 26.

Figure 8:
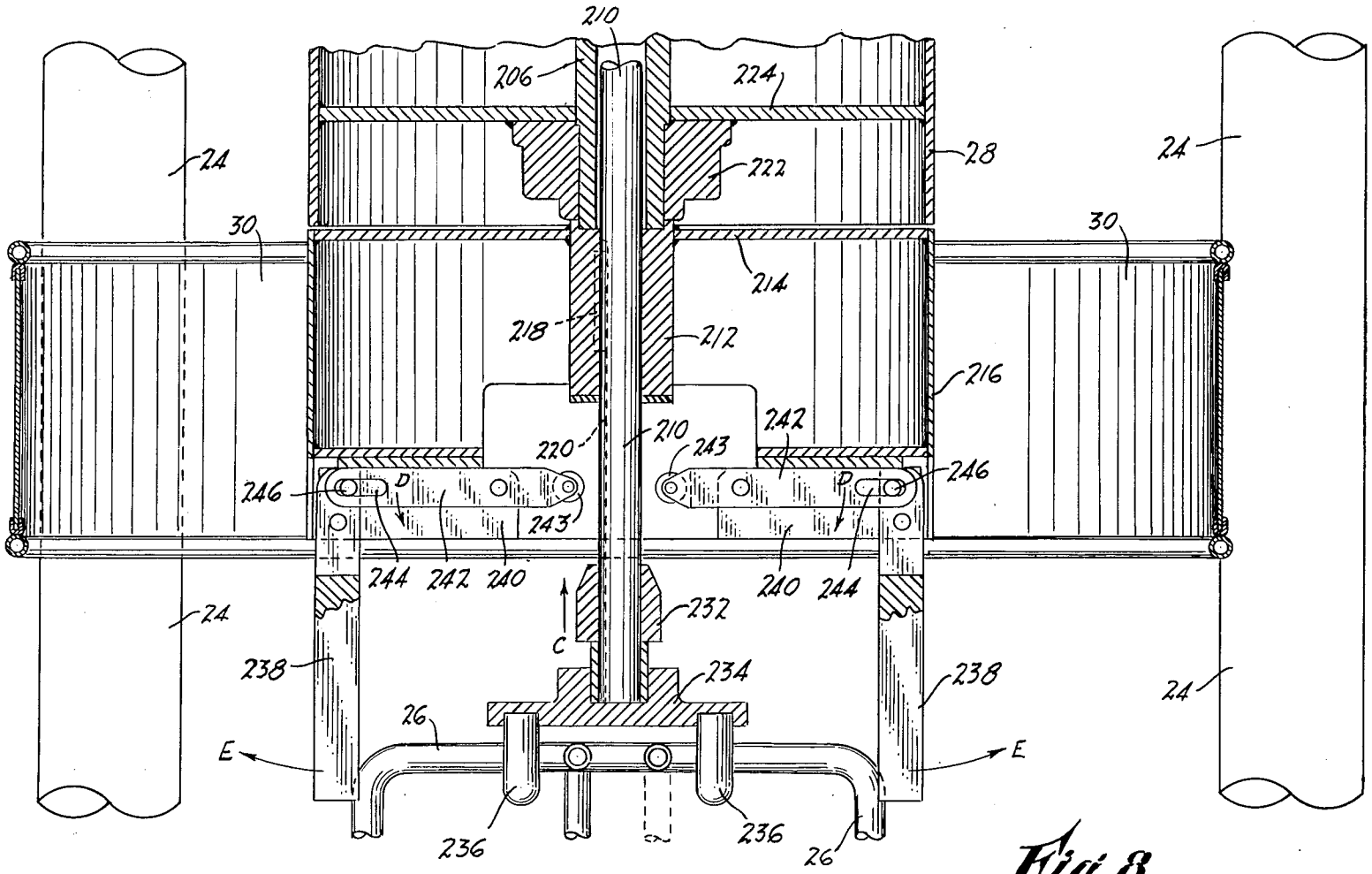
FIG. 8 is a fragmentary vertical section of the storage area of the machine of FIGS. 1–7, including a vertical drive shaft and clutch carried thereby for selective engagement with the upper bars of the reel to impart turning movement thereto as convolutions of rod or strip stock are being deposited thereon. The section is, taken on the line 8—8 of FIG. 1.
Figure 9:
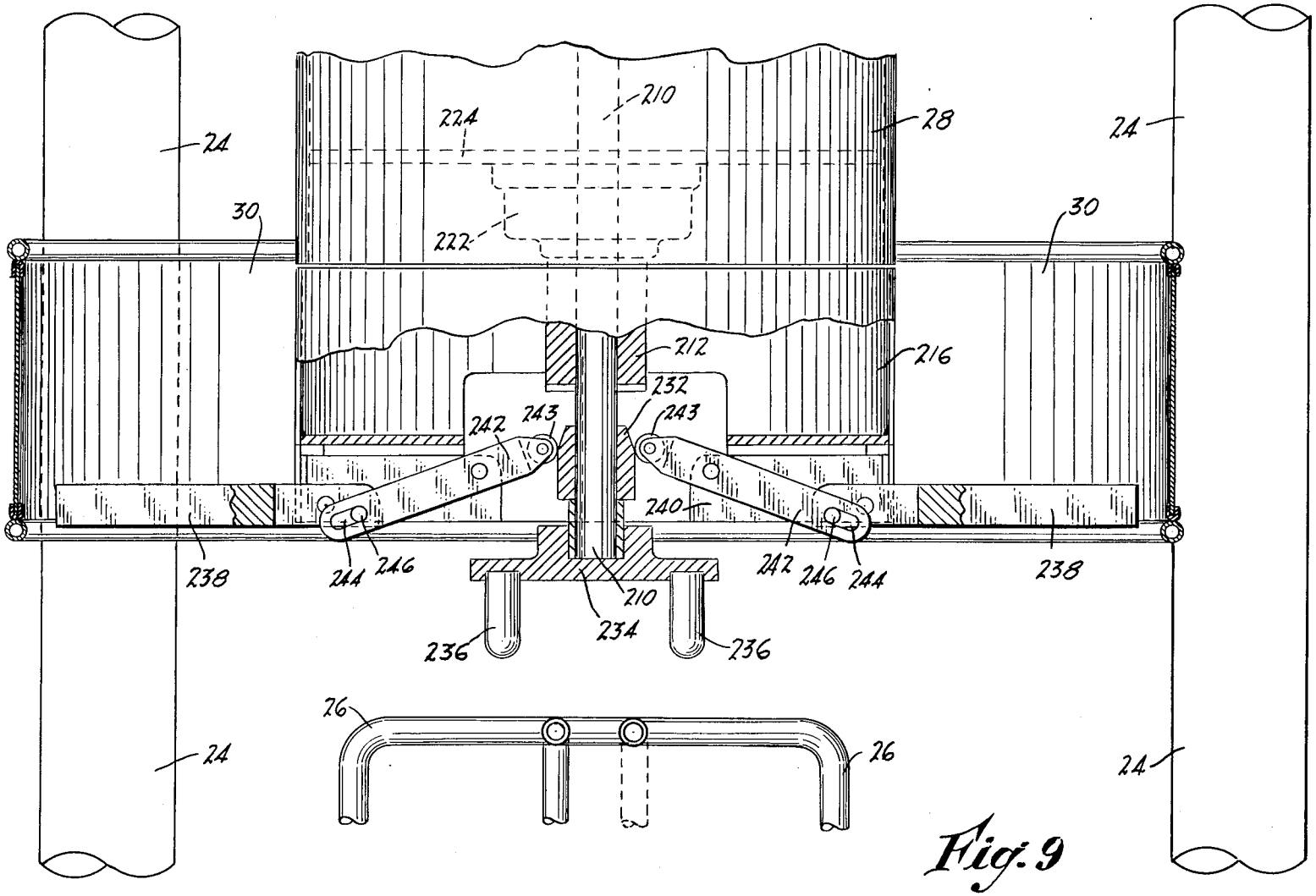
FIG. 9 is a view like that of FIG. 8 but wherein pivoted support arms associated with the storage area have been swung radially outward to positions for supporting a limited number of convolutions of rod or strip stock while reels are being exchanged.

Referring now to FIGS. 8–10 and in accordance with the present invention, powered means are provided for driving or imparting turning movement to the reel 26 through a clutch device, and for declutching the said device in order to permit manual free turning of the reel, the turntable 154 and the platform 150. In FIG. 10 there is illustrated an electric drive motor 196 mounted on the machine support structure 22, having a drive pulley 198. Also disposed on the support structure 22 is a gear box 200 having a driven pulley 202 connected with the drive pulley 198 of the motor by a belt 204. The pulleys and belt are shown in dotted outline in FIG. 10.

The gear box 200 is mounted on a platform 201 in the housing 25 by a suitable bracket. A gear (not shown) in the gear box 200 is keyed to a hollow vertical drive sleeve or shaft 206 by a spline 208 to effect turning of the sleeve 206 at a slow rate, typically several r. p. m. The drive sleeve 206 is hereinafter also referred to as an outer drive shaft. Extending longitudinally through the outer drive shaft 206 is a second vertical drive shaft 210, hereinafter referred to as an inner drive shaft. At the bottom of the outer drive shaft 206 is a bushing 212 that is rigidly secured thereto. The bushing 212 is welded to a transverse wall 214 of a lower rotatable core form 216 (FIGS. 1 and 8), and supports and drives the form 216. The bore of the bushing 212 has a groove that receives a key 218, and the outer surface of the inner drive shaft 210 is grooved at 220, and capable of slidably receiving the key 218. A vertical-axis bearing collar 222 rests upon the bushing 212, as shown. The upper end of the collar 222 is secured to a transverse wall 224 of the upper core form 28, to be supported thereby. Thus, shafts 210 and 206 are keyed for simultaneous turning, and shaft 210 can be shifted axially, within limits, of shaft 206. The lower core form 216 is seen as being juxtaposed to, and as constituting a continuation of the upper core form 28, said core forms being axially aligned and disposed end to end.

The driving shafts 206 and 210 extend through the upper, fixed core form 28.

At the top of the inner drive shaft 210 is a bearing 226 that is carried on a crosshead 228, shown in FIG. 10. The opposite ends of the crosshead 228 are connected to two fluid-controlled power units or cylinders 230 that are mounted on the platform 201 of the housing 25. Upon actuation of the cylinders, the crosshead 228 is raised to the position shown in dotted outline in the figure, carrying with it the inner drive shaft 210.

Figure 4:
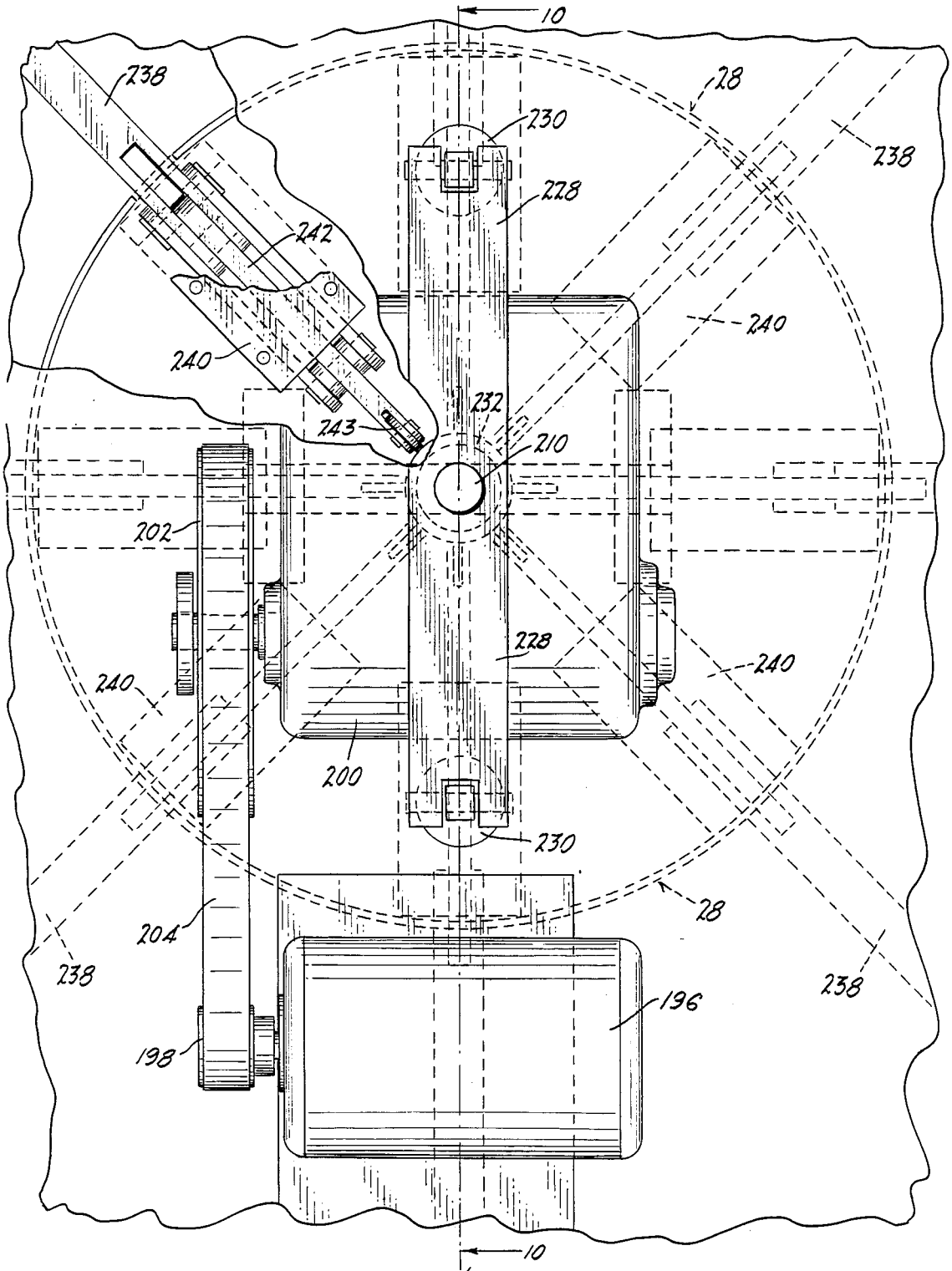
FIG. 4 is a fragmentary top plan view of another portion of the machine of FIGS. 1–3, particularly illustrating in solid outline an electric motor and gear box associated therewith, for turnably driving the reel, and illustrating six pivotable support fingers and movable core form, for effecting temporary storage of a number of convolutions of rod or strip stock while unloading of a reel is occurring.

Disposed at the lower end of the drive shaft 210 is a conical cam 232 rigidly secured thereto, and also a rigidly attached annular turnable drive member 234 having multiple depending prongs 236 that are adapted to be received in keying relation, by the upper cross members of the reel 26, the structure of such upper cross members being shown in FIGS. 1, 5 and 9. The lower core form 216 carried by the bushing 212 constitutes part of a temporary storage means for convolutions of the rod or strip stock 38 that are formed during the unloading and reloading of a reel 26. The lower core form 216 in turn carries six extendible abutments or support fingers 238 that are capable of being swung between radially extended positions shown in FIGS. 2 and 9, and essentially vertical depending positions shown in FIGS. 1 and 8. The fingers 238 are shown in detail in FIG. 4, and are pivoted on bearing blocks 240 on the lower core form 216, being actuated by cam arms 242 that extend radially thereof. The inner ends of the cam arms 242 have cam rollers 243 adapted for engagement by the conical cam 232 located at the lower end of the inner drive shaft 210. The cam arms 242 are pivoted on the bearing blocks 240, and at their ends opposite the cam rollers, have slots 244 which receive pins 246 carried by the support fingers 238. The arrangement is such that when the conical cam 232 is raised by the inner drive shaft 210, its cam surface urges the six cam rollers 243 in an axially upward direction, causing the cam arms 242 to pivot and in turn drive the fingers 238 in radially outward directions as indicated by the arrows E in FIG. 8. The fingers thus form a temporary floor, which together with the lower core form 216, constitute a containment structure that is adapted to gather convolutions of rod or strip stock 38 that are being formed continuously by the casting machine and axially advanced by the pressure rollers 70, 72, 74, 76, 78, 80, 82 and 84, past the guide rollers 134, 136. The provision of this temporary storage means permits a filled reel 26 to be unloaded and an empty one substituted in its place. Upon such substitution having occurred, the inner drive shaft 210 is again lowered and the support fingers 238 are pushed out of the way so as to enable deposit of whatever material has been accumulated in the storage means onto the newly placed reel 26. Subsequently formed convolutions fall through the above storage area and are deposited on the reel 26, as described above.

During start up of the apparatus of the present invention, the leading end of the rod or strip stock 38 received from the casting machine is directed to the guide bushing 34, thereafter passing through the movable tube 48 and stationary tube 40 of the cutter 31, FIG. 12, and into the area of the pressure rollers 70, 72, 74, 76, 78, 80, 82 and 84, FIG. 3. No cutting is required, and accordingly the cutting mechanism 31 remains stationary and out of the path of the travelling rod or strip stock 38. Since the rod or strip stock 38 is being advanced by rollers (not shown) in the casting machine, this leading end of the rod or strip stock will pass through the bushings 34 and 44 of its own volition. The pressure rollers 78, 80 are retracted during this start up operation, and the leading end of the rod or strip stock 38 travels through the first two guide bushings 128, after which the rollers 78, 80 are advanced into engagement with their corresponding drive rollers 70, 72 and a tensile force is then being applied to the end of the rod or strip stock 38 so as to advance it further along. The take-up speed of the rollers will, of course, be adjusted to correspond to the output speed of the rod or strip stock emerging from the casting machine. Continued movement of the rod or strip stock 38 will bring it into engagement with the rollers 74, 82 and 76, 84, to thus provide a more positive frictional drive.

The leading end of the rod or strip stock 38 will experience a lateral force in a radially inward direction with respect to the upper core form 28, by virtue of its engagement with the roller 134. In addition, it will also experience a lateral force in a downward direction by virtue of its engagement with the roller 136. The net result is that the rod or strip stock is formed into a generally helical shape, consisting of multiple convolutions or coils, which fall under the influence of gravity, past the upper core form 28 and onto the reel 26. At this time, the crosshead 228 occupies the lower solid-outline position shown in FIG. 10, and the support fingers 238 are vertically disposed or depending, as in FIG. 8. Both the lower core form 216 and the reel 26 are being turnably driven through the inner drive shaft 210. As noted above, the platform 150 and turntable 154 which support the reel 26 can turn freely when the latter is being driven in this manner.

As the reel 26 becomes almost filled, the cutter device 31 is actuated, either by means of suitable automatic control circuitry (not shown), or else manually. The cutter device seizes the rod or strip stock 38 at one point, and is pulled thereby toward the right as seen in FIGS. 11 and 12, as it severs the rod or strip stock. Upon completion of this operation, the cutter tooth retracts out of the path of the rod or strip stock, and the carriage 54 is returned to its starting position by the cylinder 68. The pressure rollers 70, 72, 74, 76, 78, 80, 82 and 84 continue to drive the juxtaposed ends of the rod or strip stock, through the various guide bushings 128 and into engagement with the rollers 134, 136. When the convolution containing the trailing end falls onto the reel 26, the cylinders 230 are activated, lifting the crosshead 228 and inner drive shaft 210, and causing the cam 232 to move upward as indicated by the arrow C in FIG. 8, and thereby to move the arms 242 in the directions indicated by the arrows D in FIG. 8, and to swing the support fingers 238 in the directions of the arrows E in this figure so as to arrive at their radially extended positions of FIG. 9. The rotating lower core form 216 and fingers 238 carried thereby now collect the first and subsequent convolutions of the rod or strip stock 38 that are being produced, while the operator of the equipment manually positions the platform 150 and turntable 154 with the alignment guide posts 192, 194 in registration. As noted above, both the lower core form 216 and the fingers 238 are being turnably driven from the drive shaft 210 which previously powered the reel, so as to facilitate smooth accumulation of the convolutions on the core form.

Next, the power-operated drive plunger 188 is activated, causing it to engage the driven plunger 176, thereby resulting in a pivoting of the movable stop 160 on the platform 150. This in turn enables the turntable 154 to be tilted as indicated by the arrow A in FIG. 6 to the position of FIG. 7, after which the operator can slide the reel 26 along the rollers 156 and 166 as indicated by the arrow B in FIG. 7 and load it onto a suitable conveyor, fork-lift or other vehicle. Following this, an empty reel 26 can be loaded into place, and the turntable 154 returned to its horizontal or non-tilted position of FIG. 6. Upon de-activation of the plunger 188 the movable stop 160 will return to its initial position, blocking movement of the new reel, and the support shoulder 172 of the movable stop 160 will engage the adjacent surface of the underside of the turntable as before.

With the empty reel in position, the fluid-controlled power units 230 are again activated, releasing the crosshead 228 for lowering movement and permitting those convolutions that have accumulated above the support fingers 238 to fall and be deposited onto the reel 26. Subsequent convolutions will continue to accumulate thereon, as before.

The procedure outlined above is repeated as necessary, until the desired quantity of rod or strip stock has been produced and stored.

The machine of the present invention has the following important advantages. Due to the unusual nature of the operation of the casting machine, that is, an operation which continually produces rod or strip stock essentially without interruption and at a substantially constant rate, handling and storage of the resultant rod or strip stock must be such that it does not interfere with or interrupt the casting process. That is, the cutting of the rod or strip stock to the desired lengths and the storing of it must be accomplished quickly and with a minimum of time and effort on the part of the operator of the equipment. The device of the present invention effectively solves this problem of cutting and storing such material by its ability to receive the rod or strip stock in a continuous fashion, and to simultaneously process it by selectively temporarily storing small quantities of rod or strip stock while other more substantial quantities that have been deposited on a storage device such as a reel are removed from the machine, and an empty reel substituted. Through the use of multiple drive rollers and judiciously positioned guide structures, there is minimized the possibility of problems with inadvertent bending or breakage of the rod or strip stock, and resultant down time. The machine is both rugged and reliable in use, even over extended periods of time. The operation can be largely automated through the use of relatively simple automatic electronic control equipment, resulting in an operation requiring only minimal operator attention. Relatively unskilled labor would in all likelihood suffice.

The importance of reliability can be readily appreciated, since any take-up apparatus that would be subject to frequent break-downs or substantial down-time could cause serious setbacks when employed with a continuous-duty casting machine such as that illustrated and described in the U.S. Patent above identified.

The device is thus seen to represent a distinct advance and improvement in the technology of rod and strip stock handling equipment.

Each and every one of the appended claims defines an aspect of the invention that is separate and distinct from all others, and accordingly it is intended that each claim be treated as such when examined in the light of the prior art devices in any determination of novelty or validity.

Variations and modifications are possible without departing from the spirit of the invention, and portions of the invention can be used without others.

What is claimed is:

1. A machine for coiling and for successively reeling for storage finite quantities of thick heavy gauge elongate metal stock from a continuously producing supply of the same, comprising in combination:

(a) a stationary support structure, (b) means on said support structure for carrying and rotatably mounting a vertical-axis reel thereon which is adapted to receive a quantity of said metal stock, (c) reel-driving powered means on said support structure for effecting a turning movement of the reel as the latter is carried by said mounting means, (d) carrier means for transporting a loaded reel from said mounting means, (e) powered impelling means on said support structure for axially impelling metal stock to be loaded on a reel which is rotatably mounted by said mounting means, (f) positive, helix-forming guide means on said support structure for imparting a vertical helical curl to the axially moving metal stock to form the same into a shape suitable for reeling onto a reel which is rotatably mounted, (g) means including a cutter for severing said metal stock after loading of a quantity of the same on a reel, (h) means mounting the cutter on the support structure for movement simultaneously with the metal stock from a starting to a termination position as the cutter severs the stock, (i) return power means acting on said cutter mounting means for returning the cutter from its termination position to its starting position, and (j) helix-accommodating guide means comprising a pair of axially-aligned end-to-end core forms disposed vertically one above the other for engaging inside surfaces of the curled metal stock and for positioning the same above said reel-mounting means, the upper one of said core forms being stationary and affixed to said support structure, and extending downward below the level of said helix-forming guide means and the lower one of said core forms being juxtaposted to and constituting a continuation of the upper core form, (k) said reel-driving powered means extending through the upper, fixed core form and turnably driving the lower of said core forms.

2. A machine as set forth in claim 1, wherein:

(a) said means on the support structure for carrying and rotatably mounting the reel comprises a rotary table having two spaced-apart series of rollers extending substantially in parallel directions and adapted to engage a base portion of a reel, and (b) stop means disposed on said table at a location between said series of rollers, said stop means being adapted to engage another base portion of the reel.

3. A machine as set forth in claim 1, wherein:

(a) said powered means for effecting a turning movement of the reel comprises a vertical shaft mounted on said support structure and extending through the upper core form, comprises a drive member carried by the lower end of said vertical shaft, and comprises prongs extending downward from said drive member and adapted to engage an upper portion of a reel.

4. A machine as set forth in claim 1, wherein:

(a) said carrier means for transporting a loaded reel comprises sets of rollers on the support structure, disposed in spaced-apart relation and adapted to engage a base portion of a reel.

5. A machine as set forth in claim 1, wherein:

(a) said powered means for axially moving metal stock comprises a plurality of aligned pairs of opposed wheels between which the metal stock passes, (b) corresponding wheels of said pairs being geared together for turning in the same directions.

6. A machine as set forth in claim 1, wherein:

(a) the positive guide means on the support structure comprises a wheel adapted for engagement with the metal stock at a location downstream of said impelling means, and comprises means for advancing or retracting said wheel laterally of said metal stock.

7. A machine as set forth in claim 1, wherein:

(a) said means mounting the cutter comprises a pair of parallel guide rails and a carriage slidably therealong, (b) said cutter being mounted on said carriage to travel therewith.

8. A machine as set forth in claim 1, wherein:

(a) said return power means for returning the cutter comprises a cylinder and piston, a pull cable connected to the piston and cutter, and a direction-reversing pulley around which the pull cable passes.

9. A machine as set forth in claim 1, wherein:

(a) said lower one of the core forms constitutes a temporary storage means separate and apart from said reel, for supporting curled oncoming metal stock from the continuously producing supply thereof after the cutting thereof by said cutter, for disposition on a new reel subsequent to the removal of a loaded reel from said reel carrying and mounting means.

10. In a machine for coiling and for successively reeling for storage finite quantities of thick elongate metal stock from a continuously-producing supply of the same, in combination:

(a) a support structure, (b) a reel, (c) means for removably mounting said reel with its axis upright, on said support structure, (d) powered impelling means on said support structure for axially impelling metal stock to be loaded on said reel, (e) guide means on said support structure for imparting a helical curl to the axially moving metal stock to form the same into a helical shape suitable for loading onto said reel, (f) a stationary guiding core form carried by said support structure and extending to a level below said powered stock-impelling means, for receiving and guiding the helically-shaped metal stock, (g) temporary storage means located on the support structure above said reel, comprising a vertically-extending rotatable core form disposed axially below and aligned with the stationary core form and constituting a continuation thereof, said rotatable core form being adapted to have coiled about it a quantity of said curled metal stock, (h) extendable and retractable abutment means at the lower end of said rotatable core form, for supporting said coiled quantity of metal stock, and (i) means for retracting said abutment means to drop the supported coiled metal stock onto a reel below.

11. A machine as set forth in claim 10, and further including:

(a) means carried by said support structure, providing a shield in the space surrounding said rotatable core form for confining metal stock which is being coiled on said reel.

12. A machine as set forth in claim 11, wherein:

(a) said shield-providing means comprises an annular stationary band encircling the core form in spaced relation thereto.

13. A machine as set forth in claim 10, and further including:

(a) means including a shaft passing through said stationary core form, for rotatably mounting said rotatable core form on the support structure to enable it to rotate with the moving metal stock being impelled.

14. A machine as set forth in claim 13, and further including:

(a) power means including said shaft for rotatably driving said rotary core form.

15. A machine as set forth in claim 13, wherein:

(a) said stationary core form and rotatable core form are of substantially equal diameters, with flush peripheries, (b) said core forms being coaxial with said shaft, (c) said stationary core form being rigid and supportive of said shaft.

16. A machine as set forth in claim 15, wherein:

(a) said stationary core form has a bearing sleeve for said shaft.

17. A machine as set forth in claim 16, and further including:

(a) means detachably coupling said drive shaft to said reel to drive the same in unison with said rotatable core form.

18. In a machine for coiling and for successively reeling for storage finite quantities of thick elongate metal stock from a continuously-producing supply of the same, in combination:

(a) a support structure, (b) a reel, (c) means on said support structure for carrying and rotatably mounting said reel thereon with its axis upright, said reel being adapted to receive a quantity of said metal stock, (d) reel-drive means on said support structure for effecting a turning movement of the reel as the latter is carrier by said mounting means, (e) powered impelling means on said support structure for axially impelling metal stock to be loaded on said reel, (f) guide means on said support structure for imparting a curl to the axially-moving metal stock to form the same into a shape suitable for reeling onto said reel, (g) said reel-drive means comprising a pair of telescoped relatively axially-movable, splined upright shafts disposed above said reel, (h) a separable clutch device coupled between the inner one of said shafts and said reel, said clutch device becoming de-clutched in response to raising movement of said one shaft, (i) means for applying a turning force to the other of said shafts, (j) a rotatable core form disposed axially above said reel-mounting means and rigidly mounted on the outer one of said shafts to be driven thereby, and (k) fluid power means including a cylinder and a rotary coupling actuated thereby and connected to the inner one of said shafts to raise and lower the same.

19. A machine as set forth in claim 18, and further including:

(a) extendable and retractable abutment means at the lower end of the rotatable core form, for supporting a quantity of coiled metal stock, and (b) means for extending said abutment means in response to raising movement of said inner one of said shafts.

20. A machine as set forth in claim 18, and further including:

(a) a stationary core form disposed above said rotary core form, (b) a collar encircling the said shafts, secured to said stationary core form and forming a bearing for the outer one of said shafts, (c) said fluid-power means being disposed above said stationary core form, for raising and lowering the said inner one of said shafts.

21. A machine as set forth in claim 20, wherein:

(a) said means for raising and lowering the inner one of said shafts comprises a crosshead, said cylinder being connected with said crosshead.

22. A machine as set forth in claim 21, and further including:

(a) a gear reducer disposed above the stationary core form and located below said crosshead, and (b) means drivingly connecting said gear reducer to the outer one of said shafts.

23. In a machine for coiling and for successively reeling for storage finite quantities of thick elongate metal stock from a continuously-producing supply of the same, in combination:

(a) a support structure having a vertical-axis bearing, (b) means on said support structure for carrying and rotatably mounting a reel thereon with its axis upright, said reel being adapted to receive a quantity of said metal stock, (c) powered means including a vertical shaft on said support structure for effecting a turning movement of the reel as the latter is carried by said mounting means, (d) powered impelling means on said support structure for axially impelling metal stock to be loaded on said reel, (e) guide means on said support structure for imparting a curl to the axially moving metal stock to form the same into a shape suitable for reeling onto said reel, (f) a core form having an upright axis, said core form being rotatably carried by said vertical axis bearing of the support structure above said reel and being adapted to temporarily store curled metal stock intended to be reeled, (g) extendable and retractable abutment means carried at the lower portion of said core form, (h) said abutment means comprising a plurality of pivoted fingers disposed in a circle about the axis of the core form, and (i) means including a vertically movable cone cam on said shaft for actuating said pivoted fingers 24. A machine as set forth in claim 23, and further including:

(a) a reel carried by said reel-carrying means on the support structure, and (b) a separable clutch device between said reel and said means for actuating the pivoted fingers.

25. A machine as set forth in claim 23, and further including:

(a) actuator arms pivotally carried by said core form and cooperable with said pivoted fingers to operate the same.

26. A machine as set forth in claim 25, and further including:

(a) pin-and-slot connections between the respective pivoted fingers and actuator arms.

* * * * *